US006151846A

United States Patent [19]

Marks

[11] Patent Number: 6,151,846

[45] Date of Patent: Nov. 28, 2000

[54] PIN AND SLIDE METHOD TO INSTALL AND AFFIX CLADDING

[76] Inventor: Anthony David Marks, Top Office Center, P O Box 2265, 91022 Jerusalem, Israel, 91022

[21] Appl. No.: 09/051,297

[22] PCT Filed: Jul. 18, 1996

[86] PCT No.: PCT/IL96/00059

§ 371 Date: Apr. 7, 1998

§ 102(e) Date: Apr. 7, 1998

[87] PCT Pub. No.: WO97/17515

PCT Pub. Date: May 15, 1997

[30] Foreign Application Priority Data

Nov. 7, 1995 [IL] Israel ..... 115908

[51] Int. Cl.[7] ..... E06B 1/04

[52] U.S. Cl. ..... 52/204.1; 52/212; 52/216; 52/656.6

[58] Field of Search ..... 52/204.1, 656.2, 52/656.5, 656.6, 202, 211, 212, 216

[56] References Cited

U.S. PATENT DOCUMENTS

| | | | |
|---|---|---|---|
| 2,793,721 | 5/1957 | Sterud . | |
| 2,939,185 | 6/1960 | Ader et al. . | |
| 4,246,731 | 1/1981 | Miro | 52/204 |
| 4,407,100 | 10/1983 | Huelsekopf | 52/212 |
| 4,837,996 | 6/1989 | Eckelt | 52/235 |
| 5,155,956 | 10/1992 | Norment et al. | 52/217 |
| 5,746,033 | 5/1998 | Chuang | 52/213 |

*Primary Examiner*—Beth A. Stephan
*Assistant Examiner*—Brian E. Glessner
*Attorney, Agent, or Firm*—Kolisch Hartwell Dickinson McCormack & Heuser

[57] ABSTRACT

Method to install and affix all kinds of building cladding to both new and existing building structures and to any free-standing structure. The method covers the mounting and securing in place of window and door surrounds and panels made from pre-cast stone or other material. The cladding elements to be mounted and affixed have protruding pins that align with openings to channels or slides located on a support frame which has been secured to the inner periphery of the building reveal, aperture or recessed area to be covered.

11 Claims, 2 Drawing Sheets

PIN AND SLIDE METHOD TO INSTALL AND AFFIX CLADDING

TECHNICAL FIELD

This invention relates to the installation of cladding for building structures and other free-standing structures, and to the installation of panels in such structures.

BACKGROUND ART

Cladding around window and door surrounds is used for adorning building facades. The traditional method of creating cladding is to manufacture the component parts in a factory and then to ship those component parts to the building site. The component parts are then mounted on the window or door reveal using mortar applied between the component parts and the building facade, and between the component parts themselves.

This method has a number of inherent limitations. Firstly, it requires skilled workers, i.e. masons at the site for the assembly and construction of the cladding; secondly it is time-consuming; and thirdly, the finished cladding does not permit the components to move relative to one another. This last problem leads to cracking and crazing of the cladding and/or the building structure around the window or door reveal over time due to strains and stresses within the building.

U.S. Pat. No. 1,850,292 (Skelly) discloses a cabinet mounted in a recess of a wall (e.g. in a bathroom) by means of a fixing device comprising two V-shaped lugs, each mounted to a plate. One lug is attached to the building wall and the other to the cabinet. In use, a set of lugs, on each side of the cabinet, interlock to hold the cabinet immovably in position in the recess.

DE-C-79 383 (Grove) discloses means for attaching an inspection cover plate to a recess in a pipe conduit. The inspection cover plate has two hook-like flanges attached to the underside thereof. A frame in the recess for receiving the cover plate has slots into which the flanges are placed. The cover plate is then slid to one side and the flanges are jammed beneath and behind the frame, thus securing the cover plate.

EP-A-0 282 686 (Eckelt) relates to the installation of glass facades in a surrounding frame. The horizontal members of the frame are provided with hook-shaped slots which receive pins carried by the glass facade, such that the facade is locked rigidly into position in the surrounding frame by the slot-and-pin arrangement.

DE-A1-42 04 869 (Waldner) relates to a coupling for securing a laminar building component, especially a screen, to another laminar building component, especially a wall element or a ceiling element. The coupling consists of a first coupling member which is secured to one of the laminar building components, and a second coupling member which is secured to the other laminar building component. At least two guides are formed in the first coupling member, the guides describing circular arcs with a common centre and different radii. One of the guides extends almost rectilinearly and the other extends arcuately. At least two pins on the second coupling member may be located in the guides. To secure the laminar building component one pin is placed in the arcuate guide and is pushed thereinto until the second pin engages its corresponding rectilinear guide. The two pins are then pushed home, the pin in the rectilinear guide being held securely in place by a snap-in device and the other pin being held in place due to the arcuate shape of the other guide.

Where the building component is a wall element the arcuate guide can extend in a generally downward direction.

The building component may be detached by reversing the above attachment steps. Thus, when using such a coupling the building component is securely seated in all three spatial dimensions and can nevertheless be released again without ancillary means and without dismantling any connector.

DE-1 659 541 (B.I.P. Brevets Inventions Promotions S.A.) discloses an adjustable door and window frame assembly for various openings and a method for its installation. The frame assembly consists of a frame to be fixed in the window or door opening, adjustable connectors for mounting on the frame and an outfit for clothing the frame which is received on the connectors.

In practice, the frame is first fixed in the opening. Connectors are then positioned in slots in the vertical sides of the frame and are adjusted so as to accommodate the outfit for clothing the frame. These connectors are in the form of brackets onto which corresponding flanges on the outfit sit. The horizontal part of the outfit is fixed to the frame by bolting it to connecting plates.

Fitting such a frame assembly would take some time and would require skilled labour, as the connectors must be carefully adjusted to receive the outfit correctly. Once in place the frame assembly is firmly secured within the window or door opening.

The term "cladding" as used herein means all kinds of decorative or functional wall coverings for building structures or any kind of free-standing structures. In particular, it includes all types of coverings for both external and internal building walls and freestanding walls.

The term "reveal" as used herein means a wall opening, aperture or recess for a window or door surround or a panel. It is the portion of the side of a door or window between the line where the window frame or door frame stops and the outer edge of the opening starts.

DISCLOSURE OF INVENTION

The invention provides a cladding structure, comprising an outer frame mountable in a reveal and a cladding element mountable on said outer frame, the outer frame having a plurality of channels each of which is open at one end and is downwardly angled from said open end to a closed end, the cladding element having a plurality of pins projecting therefrom, said pins being located within and supported by said channels, whereby the cladding element is supported by the outer frame.

The structure of the present invention can be assembled easily without requiring skilled workers. Furthermore, since no mortar is required and the frame and cladding element are not bonded to one another, there is a freedom of movement which allows the structure to absorb stresses and strains.

Preferably, each channel has a first section which slopes at a downward angle from the open end and a second section in the form of a recess located at the end of the first section and into which the pin drops in use.

This arrangement is preferable since the pins need only be placed into the open end of the channel and pushed towards the frame for assembly to be completed, and gravity then carries the pins downward towards and into the recess.

Further, preferably, the first section extends into the frame for a distance of approximately half of the depth of the frame.

Further, preferably, the cladding element, when mounted on the outer frame, has sufficient freedom of movement to eliminate stresses and strains imposed thereon, whereby cracking or crazing of the cladding element is avoided.

Further, preferably, the cladding element is fixed in place solely by the location of the pins within the channels and other mounting means are unnecessary.

Suitably, the cladding element is formed of a pre-cast material, such as of pre-cast stone.

The invention also provides a cladding element for use in a cladding structure according to the invention, having pins extending therefrom for location within the downwardly angled channels of an outer frame.

In a further aspect the invention provides an outer frame for use in a cladding structure according to the invention, having a plurality of channels open at one end and downwardly angled from said open end to a closed end.

In yet a further aspect the invention provides a method of mounting a cladding structure to a reveal, comprising the steps of:

a) affixing an outer frame to the reveal, the outer frame having a plurality of channels open at one end and downwardly angled from said open end to a closed end;

b) mounting a cladding element on said outer frame by locating a plurality of pins provided on the cladding element within said channels, whereby the pins are supported in the channels and the cladding element is thereby supported by the outer frame.

BRIEF DESCRIPTION OF THE DRAWINGS

The invention will be further illustrated by the following description of embodiments thereof, given by way of example only with reference to the accompanying drawings, in which.

MODES FOR CARRYING OUT THE INVENTION

Figure 1:
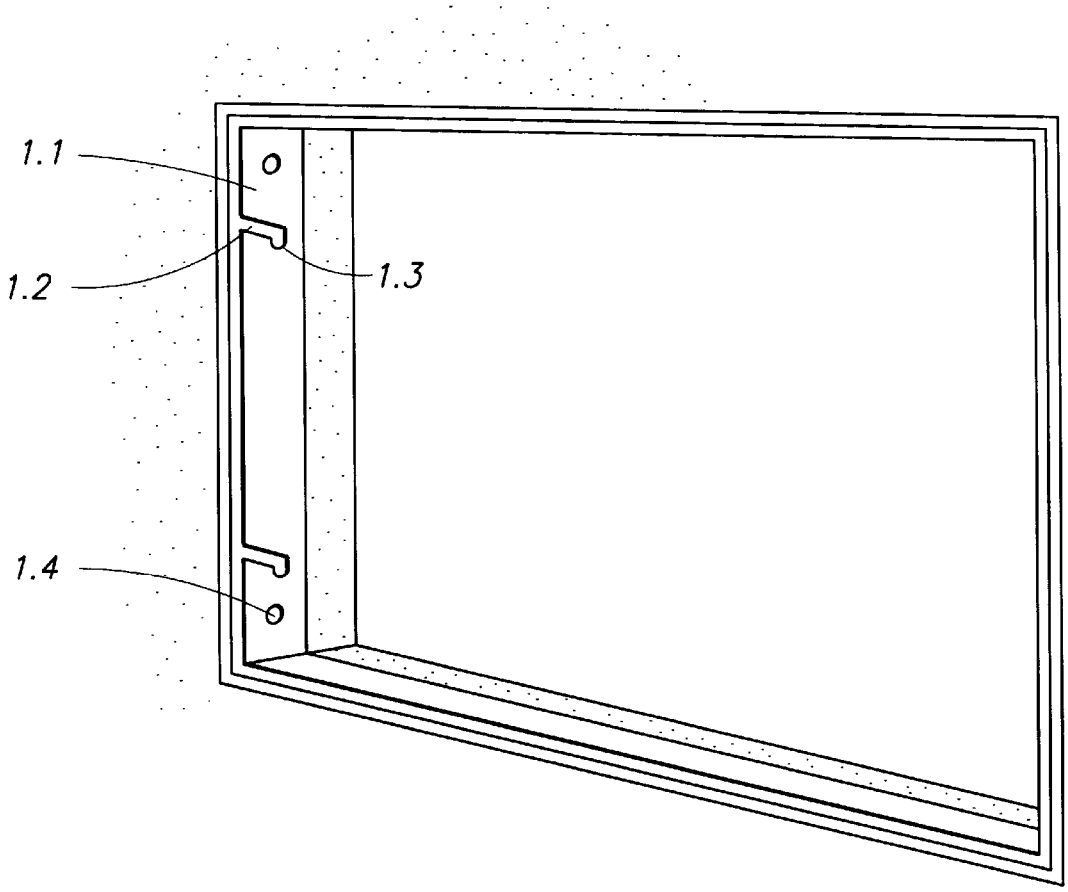
FIG. 1 is a perspective view of an outer frame according to the invention.

In FIG. 1, an outer frame 1.1 for a cladding structure according to the invention is depicted. The frame 1.1 is made of a non-corrodible metal or other suitable material, and is dimensioned to fit within a window or door reveal in a surrounding wall. The outer frame 1.1 is mounted in the reveal by a plurality of countersunk bolts 1.4.

Figure 1A:
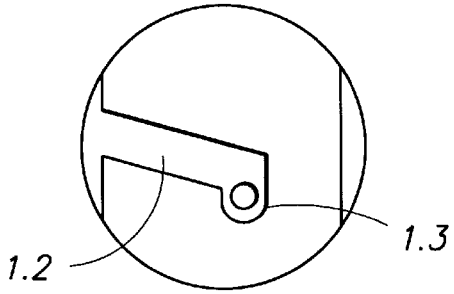
FIG. 1A is an elevation of a detail of the frame of FIG. 1.

Located on the lateral or vertical sides of the outer frame are a set of channels 1.2, shown in more detail in FIG. 1A. The channels are downwardly angled at a slight angle from an open end to a closed end located approximately halfway into the depth of the frame. It can be seen that the closed ends of the channels are in the form of semi-circular cut-outs or recesses the purpose of which will be explained more fully below.

Figure 2:
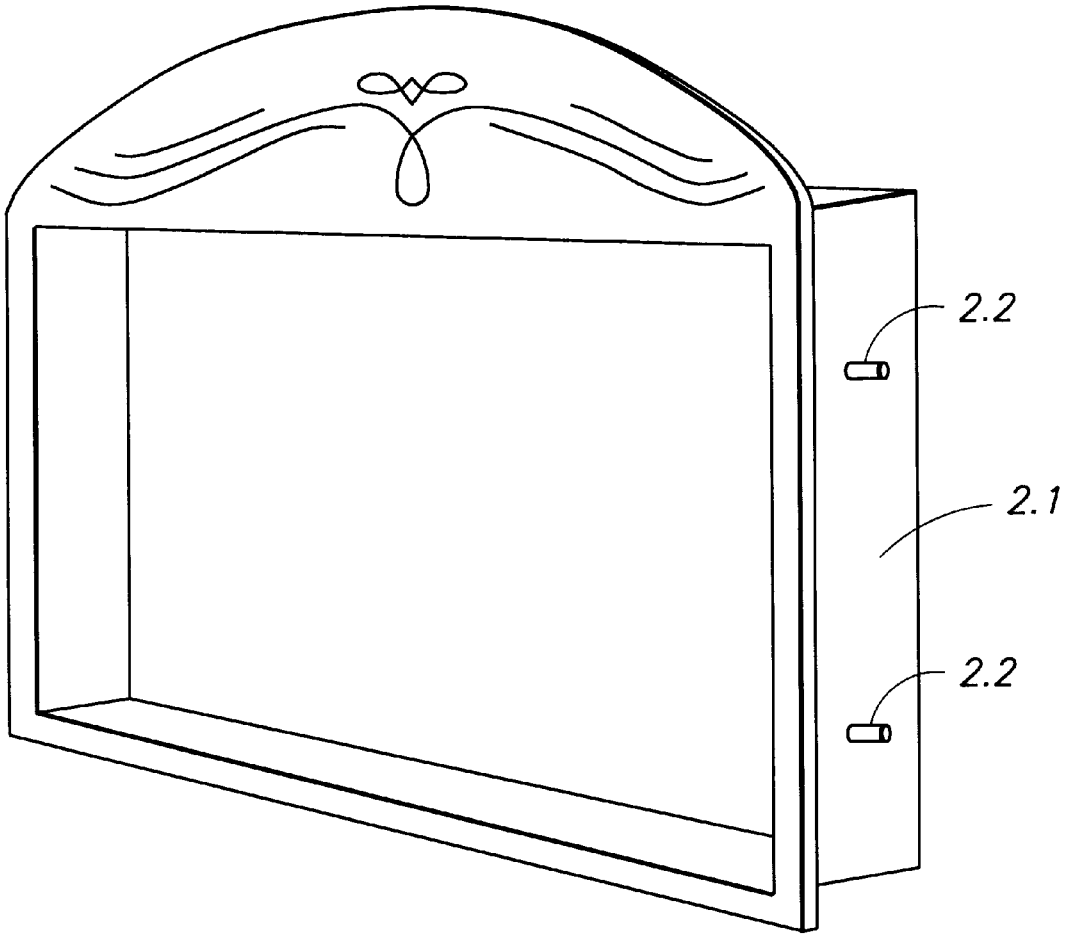
FIG. 2 is a perspective view of a cladding element according to the invention.

Referring next to FIG. 2, a cladding element 2.1 made of pre-cast stone or other material is shown. This cladding element 2.1 is provided with a plurality of pins 2.2 projecting from its vertical sides. The positions of the pins correspond precisely to the positions of the channels 1.2 of the outer frame 1.1 (FIG. 1).

The cladding element 2.1 is mounted within the outer frame 1.1 by aligning the pins 2.2 with the open ends of the channels 1.2 in the outer frame 1.1, and then gently pushing the cladding element 2.1 into the outer frame 1.1. The force of gravity then causes the pins to slide down the channels, coming to rest in the semi-circular recesses at the closed ends of the channels 1.2. This holds the cladding element securely and permanently in place, but with a degree of freedom of movement sufficient to eliminate any stresses and strains imposed on the cladding element, so that cracking or crazing of the cladding element is avoided. The cladding element 2.1 rests on its own weight and does not require mortar, screws, bolts, or any other fastening hardware.

What is claimed is:

1. A cladding structure, comprising an outer frame mountable in a reveal and a cladding element mounted on said outer frame, the outer frame having a plurality of channels each of which is open at one end and is downwardly angled from said open end to a closed end, the channels having substantially parallel first sections extending downwardly and inwardly from the open ends, the cladding element having a plurality of pins projecting therefrom, said pins being located within and supported by said channels, whereby the cladding element is supported by the outer frame.

2. A cladding structure according to claim 1, wherein each channel further includes a second section extending downwardly from the first section, the second section being a recess located at the end of the first section and into which the pin drops in use.

3. A cladding structure according to claim 2, wherein the first section extends into the frame for approximately half of the depth of the frame.

4. A cladding structure according to claim 1, wherein the cladding element, when mounted on the outer frame, has freedom of movement sufficient to eliminate stresses and strains imposed thereon, whereby cracking or crazing of the cladding element is avoided.

5. A cladding structure according to claim 1, wherein the cladding element is fixed in place solely by the location of the pins within the channels and other mounting means are unnecessary.

6. A cladding structure, comprising an outer frame mountable in a reveal and a cladding element, formed of a pre-cast material, mounted on said outer frame, the outer frame having a plurality of channels each of which is open at one end and is downwardly angled from said open end to a closed end the charnels having substantially parallel first sections extending downwardly and inwardly from the open ends the cladding element having a plurality of pins projecting therefrom, said pins being located within and supported by said channels, whereby the cladding element is supported by the outer frame.

7. A cladding structure according to claim 6, wherein the cladding element is formed of pre-cast stone.

8. A method of mounting a cladding structure to a reveal, comprising the steps of:

a) affixing an outer frame to the reveal, the outer frame having a plurality of channels open at one end and downwardly angled from said open end to a closed end, the channels having substantially parallel first sections extending downwardly and inwardly from the open ends, and a recess located adjacent an inward end of each of the first sections;

b) mounting a cladding element on said outer frame by locating a plurality of pins provided on the cladding element within said channels, sliding the cladding element downwardly along the substantially parallel first sections of the channels until the pins come to rest in a respective recess, whereby the pins are supported in the channels and the cladding element is thereby supported by the outer frame.

9. A cladding element for use in a cladding structure having an outer frame mountable in a reveal, the outer frame having a plurality of channels each of which is open at one end and is downwardly angled from said open end to a closed end, the channels having substantially parallel first sections extending downwardly and inwardly from the open ends, the cladding element comprising a cladding element body and a plurality of pins projecting therefrom, said pins being located within and supported by said channels, whereby the cladding element is supported by the outer frame.

10. An outer frame for use in a cladding structure, the outer frame comprising a frame structure and a plurality of channels positioned therein, each of the channels being open at one end and downwardly angled from said open end to a closed end, the channels having a U-shaped recess positioned adjacent to the inward end of each of the first sections, wherein each U-shaped recess is configured to receive and support a respective pin of the cladding structure at a bottom of the recess, and is laterally oversized relative to the pin, and is open to the top, to thereby allow the pin limited movement horizontally and upward to inhibit cracking or crazing of the cladding element.

11. The cladding structure of claim 1, wherein each recess is U-shaped and laterally oversized relative to the pin, and is open to the top, such that each recess is configured to support a pin at a bottom of the recess, while allowing the pin limited movement horizontally and upward to inhibit cracking or crazing of the cladding element.

* * * * *